US005277152A

United States Patent [19]

Liao

[11] Patent Number: 5,277,152

[45] Date of Patent: Jan. 11, 1994

[54] WATER HEATER

[76] Inventor: Hsin-Yen Liao, No. 48 Ning Hsia East 1st Street, Taichung, Taiwan

[21] Appl. No.: 5,096

[22] Filed: Jan. 15, 1993

[51] Int. Cl.[5] ..... F22B 15/00

[52] U.S. Cl. ..... 122/13.2; 122/4 A; 392/485; 392/486

[58] Field of Search ..... 122/13.1, 13.2, 4; 392/311, 314, 318, 451, 452, 485, 486

[56] References Cited

U.S. PATENT DOCUMENTS 4,354,094 10/1982 Massey et al. ..... 122/13.2 X 4,862,834 9/1989 Kurz et al. ..... 122/13.1

*Primary Examiner*—Edward G. Favors

*Attorney, Agent, or Firm*—Pierre Lespéance; Francois Martineau

[57] ABSTRACT

A water heater includes a base formed in a board, a control device disposed on the base, a vessel fixed to the board and connected to the base, and a heater disposed in the vessel for heating the water contained in the vessel. The water heater occupies a small volume and includes a simplified structure such that the manufacturing cost of water heater can be greatly reduced.

2 Claims, 4 Drawing Sheets

WATER HEATER

BACKGROUND OF THE INVENTION

1. Field of the Invention

The present invention relates to a water heater.

2. Description of the Prior Art

Typically, water heater occupies a huge volume and includes a complicated configuration such that the water heater is very expensive.

The present invention has arisen to mitigate and/or obviate the afore-described disadvantages of the conventional water heaters.

SUMMARY OF THE INVENTION

The primary objective of the present invention is to provide a water heater which occupies a small volume and includes a simplified configuration such that the manufacturing fees thereof is greatly reduced.

In accordance with one aspect of the invention, there is provided a water heating mechanism comprising a board including a base formed therein, a depression formed in a front portion of the base, a first passage and a second passage formed in the base and communicated with the depression, a path formed in a rear portion of the board and communicated with the second passage of the base, an orifice formed through the board and communicated with the path, a hole formed in the base, an inlet pipe connected to the hole of the base for supplying water into the hole, a membrane engaged on the base and including a first opening communicated with the hole and a second opening communicated with the first passage of the base, a bolt fixed to the membrane, a cap engaged on the membrane and including a recess formed therein, a first access and a second access formed in the cap and communicated with the recess and communicated with the first opening and the second opening of the membrane respectively such that water from the inlet pipe may flow into the recess of the cap via the hole and the first opening and the first access and then may flow into the depression of the base via the second access and the second opening and the first passage, the cap including a puncture formed in the recess for receiving the bolt, a vessel fixed to the board and including a tube connected to the orifice such that the water contained in the depression of the base may flow into the vessel, an outlet pipe coupled to the vessel, and a heater disposed in the vessel for heating the water contained in the vessel, the membrane being balanced when the outlet pipe is closed, and the membrane being caused to move inwards of the depression of the base when the outlet pipe is opened, whereby, the bolt is caused to move inwards of the cap when the outlet pipe is opened.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
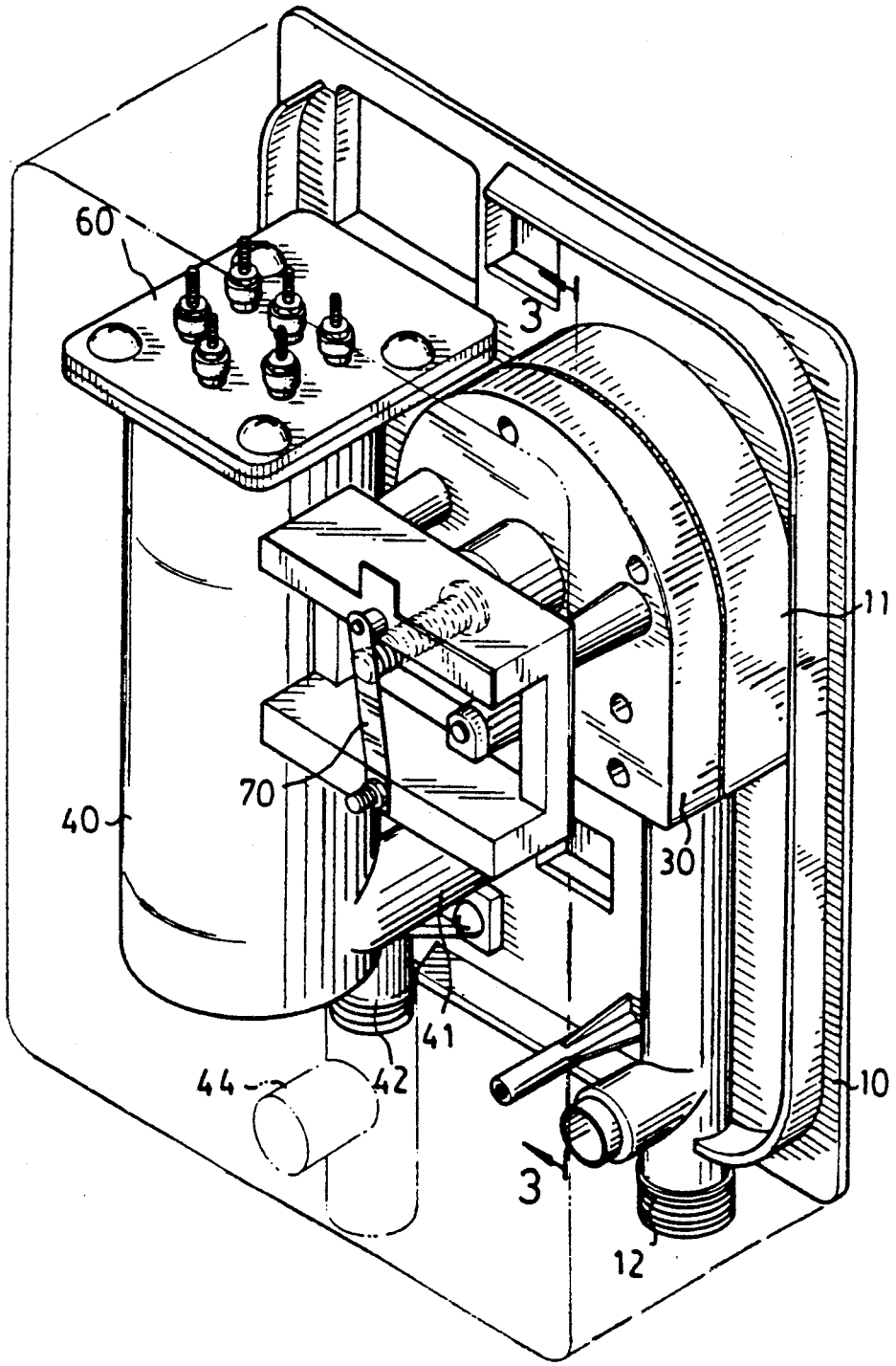
FIG. 1 is a perspective view of a water heater in accordance with the present invention.

Referring to the drawings, and initially to FIG. 1, a water heater in accordance with the invention comprises generally a board 10 for fixing to the wall, a control device 20 fixed to the board 10, a vessel 40 fixed to the board 10, and a heater 60 disposed in the vessel 40. The control device 20 is provided for controlling the water supplied to the vessel 40 and for controlling the operations of the heater 60.

Figure 2:
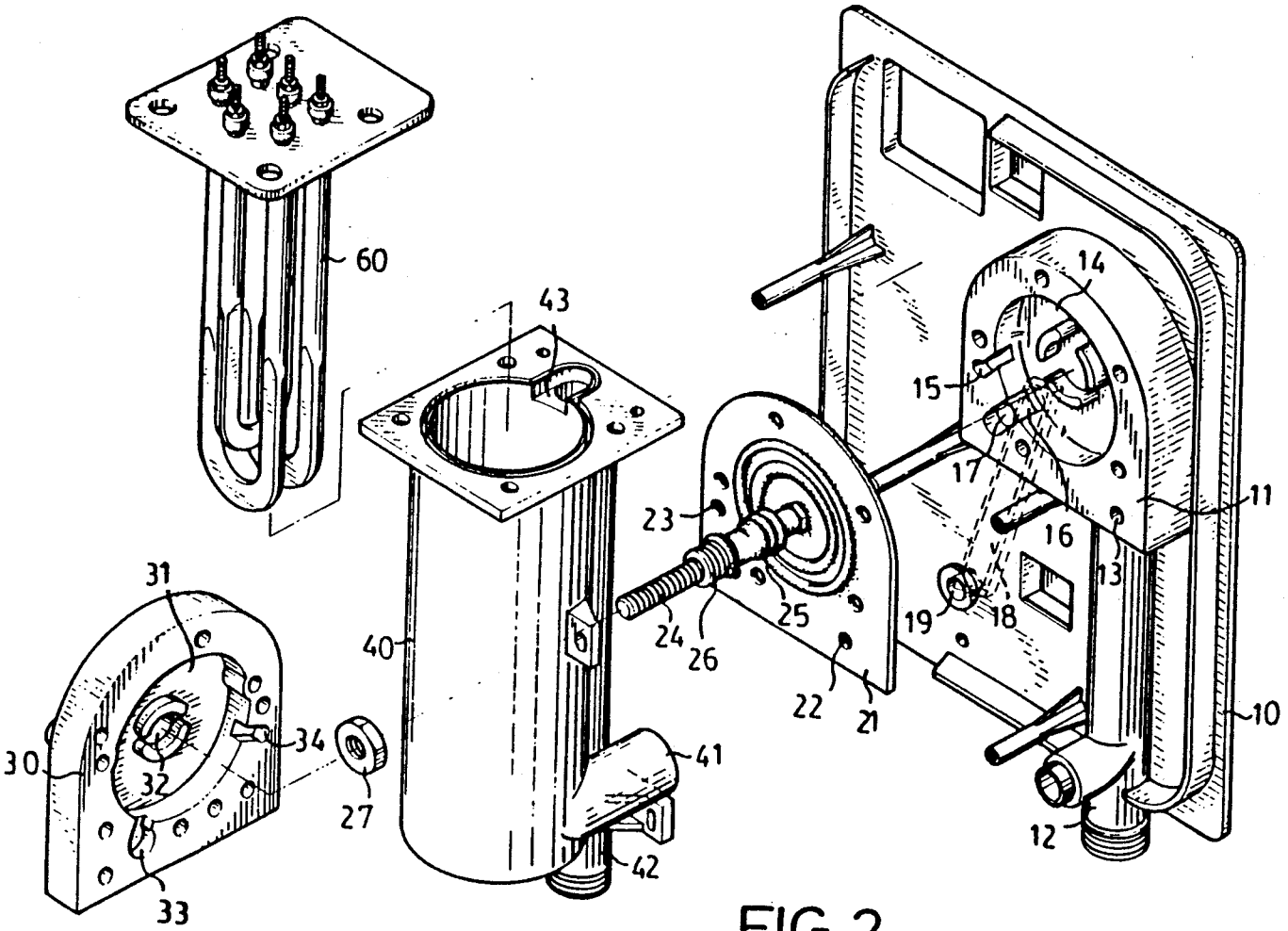
FIG. 2 is an exploded view of the water heater.

Referring next to FIGS. 2 and 3, and again to FIG. 1, the board 10 includes a base 11 formed thereon, the base 11 including a hole 13 and a depression 14 formed therein, an inlet pipe 12 connected to the hole 13 of the base 11 for supplying water into the hole 13, two passages 15, 16 formed in the base 11 and communicated with the depression 14, an aperture 17 extended through the board 10 and communicated with the passage 16, a path 18 formed in the rear portion of the board 10 and having one end communicated with the aperture 17 and having the other end communicated with an orifice 19 which also extended through the board 10, such that water contained in the depression 14 may flow through the path 18 via the passage 16 and the aperture 17.

The control device 20 includes a membrane 21 engaged on the base 11 of the board 10 and includes two openings 22, 23 communicated with the hole 13 and the passage 15 of the base 11 respectively, a bolt 24 fixed to the membrane 21, a resilient sleeve 25 engaged on the bolt 24 and fixed to the membrane 21, a block 26 engaged on the bolt 24 and fixed to the resilient sleeve 25 and having an outer thread formed on the outer peripheral portion thereof, a nut 27 threadedly engaged with the block 26, and a cap 30 engaged on the membrane 21. The cap 30 includes a recess 31 formed therein, a puncture 32 formed in the center portion of the recess 31, two accesses 33, 34 formed in the cap 30 and communicated with the recess 31 and communicated with the openings 22, 23 of the membrane 21 respectively, such that the water from the inlet pipe 12 may flow into the recess 31 of the cap 30 via the hole 13 of the base 11 and the opening 22 of the membrane 21 and the access 33 of the cap 30, the water contained in the recess 31 of the cap 30 then may flow into the depression 14 of the base 11 via the access 34 of the cap 30 and the opening 23 of the membrane 21 and the passage 15 of the base 11, the water contained in the depression 14 then may flow through the path 18 via the passage 16 and the aperture 17 of the base 11. The bolt 24 and the block 26 extend through the puncture 32 of the cap 30, and a nut 27 is threadedly engaged with the block 26, best shown in FIG. 3, so as to fix the block 26 to the cap 30. The control device 20 further includes a switch 70 fixed to the cap 30.

The vessel 40 includes a tube 41 connected to the orifice 19 of the board 10 such that the water from the inlet pipe 12 may flow into the vessel 40 via the control device 20, and an outlet pipe 42 disposed beside the vessel 40, an approach 43 is formed in the upper portion of the vessel 40 for communicating the interior of the vessel 40 with the outlet pipe 42, such that the water contained in the vessel 40 may flow out of the outlet pipe 42 via the approach 43. The heater 60 is provided to heat the water contained in the vessel 40. A valve 44 is disposed in the lower portion of the outlet pipe 42 for controlling the passage through the outlet pipe 42. It is to be noted that the approach 43 is formed in the upper portion of the vessel 40 such that the water from the tube 41 may be heated by the heater 60 before flowing out of the outlet pipe 42 via the approach 43.

Figure 3:
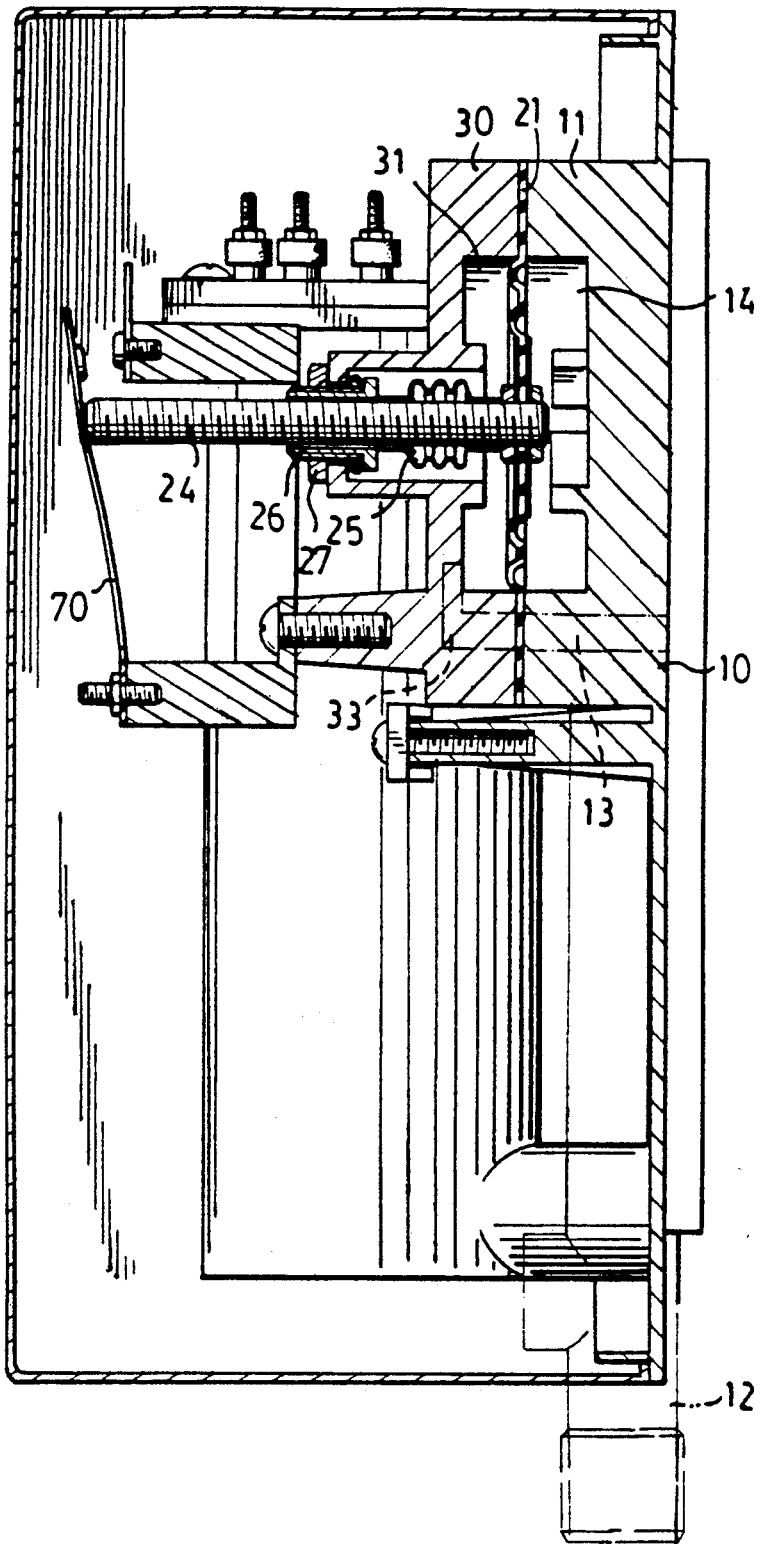
FIGS. 3 and 4 are cross sectional views taken along lines 3—3 of FIG. 1, illustrating the operations of the water heater.
Figure 4:
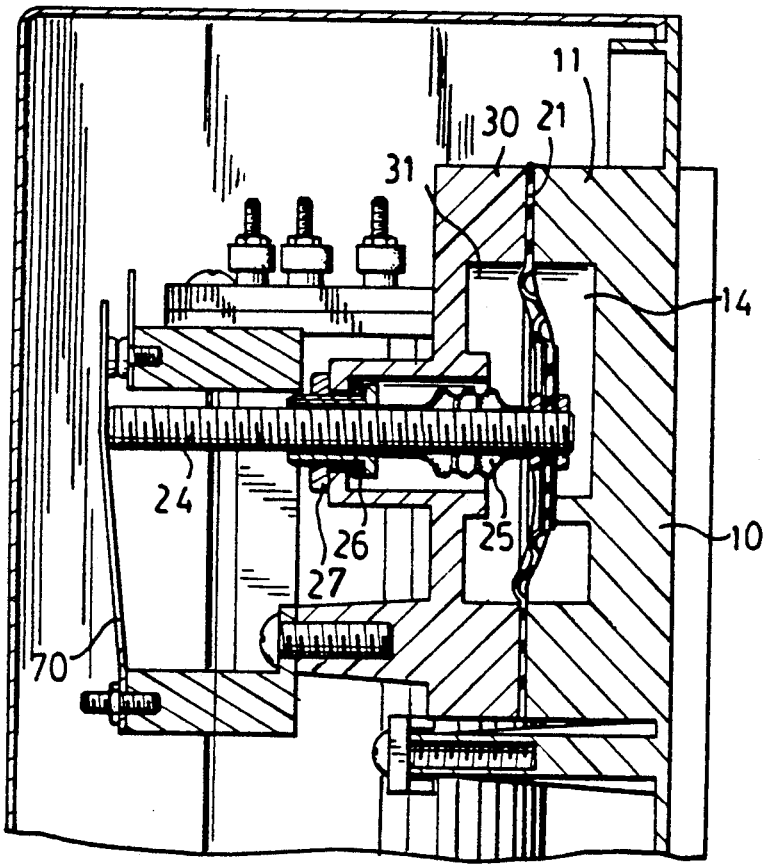

In operation, referring next to FIGS. 3 and 4, the inlet pipe 12 is normally opened such that water is continuously supplied into the recess 31 of the cap 30 and the depression 14 of the base 11 such that the pressures on both sides of the membrane 21 is balanced if the outlet pipe 42 is closed by the valve 44; at this moment, the bolt 24 is extended outward of the cap 30, and the switch 70 is not actuated such that the heater 60 is not energized; however, when the outlet pipe 42 is opened, the water continuously flows into the recess 31 of the cap via the inlet pipe 12 such that the membrane 21 is depressed inwards of the depression 14 of the base 11 and such that the bolt 24 is caused to move inwards of the cap 30, at this moment, the switch 70 is actuated in order to energize the heater 60. When the outlet 42 is closed again, the pressures on both sides of the membrane 21 are balanced again, and the membrane 21 can be recovered by the resilient sleeve 25.

Accordingly, the water heater in accordance with the present invention occupies a small volume and includes a simplified configuration such that the manufacturing costs thereof can be greatly reduced.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A water heating mechanism comprising a board including a base formed therein, a depression formed in a front portion of said base, a first passage and a second passage formed in said base and communicated with said depression, a path formed in a rear portion of said board and communicated with said second passage of said base, an orifice formed through said board and communicated with said path, a hole formed in said base, an inlet pipe connected to said hole of said base for supplying water into said hole, a membrane engaged on said base and including a first opening communicated with said hole and a second opening communicated with said first passage of said base, a bolt fixed to said membrane, a cap engaged on said membrane and including a recess formed therein, a first access and a second access formed in said cap and communicated with said recess and communicated with said first opening and said second opening of said membrane respectively such that water from said inlet pipe may flow into said recess of said cap via said hole and said first opening and said first access and then may flow into said depression of said base via said second access and said second opening and said first passage, said cap including a puncture formed in said recess for receiving said bolt, a vessel fixed to said board and including a tube connected to said orifice such that said water contained in said depression of said base may flow into said vessel, an outlet pipe coupled to said vessel, and a heater disposed in said vessel for heating said water contained in said vessel, said membrane being balanced when said outlet pipe is closed, and said membrane being caused to move inwards of said depression of said base when said outlet pipe is opened, whereby, said bolt is caused to move inwards of said cap when said outlet pipe is opened.

2. A water heating mechanism according to claim 1 further comprising means for recovering said membrane when said outlet pipe is closed.

* * * * *